US006082272A

United States Patent [19]

Adrain

[11] Patent Number: 6,082,272

[45] Date of Patent: Jul. 4, 2000

[54] SAFE FOR SUPPORTING A BED

[76] Inventor: John B. Adrain, P.O. Box 299, Salt Lake City, Utah 84100-0299

[21] Appl. No.: 09/145,122

[22] Filed: Sep. 2, 1998

Related U.S. Application Data

[60] Provisional application No. 60/057,872, Sep. 2, 1997.

[51] Int. Cl.[7] ..... E05G 1/04

[52] U.S. Cl. ..... 109/51; 109/56; 5/308; 5/921

[58] Field of Search ..... 109/50–53, 49, 109/45, 1 R, 56, 57, 67; 5/308, 400, 931; 70/63

[56] References Cited

U.S. PATENT DOCUMENTS

| | | | |
|---|---|---|---|
| 491,875 | 2/1893 | Corry | 109/49 |
| 3,669,037 | 6/1972 | Rossel | 109/49 |
| 4,460,085 | 7/1984 | Jantzen | 206/349 |
| 4,597,122 | 7/1986 | Handler et al. | 5/308 |
| 4,648,550 | 3/1987 | Clearly, Jr. | 109/56 |
| 5,095,566 | 3/1992 | Russell | 5/308 |
| 5,317,888 | 6/1994 | Towns | 5/308 |
| 5,488,914 | 2/1996 | Ouellette | 109/50 |
| 5,558,027 | 9/1996 | William et al. | 109/45 |
| 5,746,140 | 5/1998 | Flood | 109/51 |

FOREIGN PATENT DOCUMENTS

| | | | |
|---|---|---|---|
| 0234509 | 9/1987 | European Pat. Off. | 109/1 R |

*Primary Examiner*—Darnell M. Boucher
*Attorney, Agent, or Firm*—Pearne, Gordon, McCoy & Granger LLP

[57] ABSTRACT

Two enclosure are secured together to provide a safe the size and shape of a box spring for supporting a mattress. Wheels and handles are provided for transport. Fasteners for the enclosure, wheels, and handles are accessible only from the interior of the enclosures to inhibit unauthorized movement of the safe.

5 Claims, 2 Drawing Sheets

SAFE FOR SUPPORTING A BED

CROSS-REFERENCE TO RELATED APPLICATIONS

Priority is hereby claimed based on U.S. Provisional application 60/057,872, dated Sep. 2, 1997.

STATEMENT REGARDING FEDERALLY SPONSORED RESEARCH OR DEVELOPMENT

Not Applicable

BACKGROUND OF THE INVENTION

This invention relates generally to the field of safes and specifically to a movable domestic safe for supporting a bed.

Safes are heavy and can be relatively large. A safe structure that is accessible, uses space efficiently, and is relatively simple to move is desirable. Unauthorized movement must be inhibited.

BRIEF SUMMARY OF THE INVENTION

The present invention provides a safe including first and second each enclosures defined by four side walls and a bottom and having an opening. The second enclosure is positioned such that one of the walls of the second enclosure is adjacent one of the walls of the first enclosure. Multiple corresponding holes are provided through the adjacent walls. Fasteners are disposed in the holes for securing the first and second enclosures together, the fasteners being accessible only from the interior of the enclosures. A first door closes the opening of the first enclosure and a second door closes the opening of the second enclosure. Hinges along respective top edges of the adjacent walls pivotably attach the doors to the enclosures, the hinges being recessed so as not to protrude above the doors. Locks for lock the first and second doors. Mounting holes are provided in the bottom walls. Feet are adapted for being mounted in the mounting holes, the feet being adjustable and being removable only by access from the interior of the enclosures. Wheels are adapted for being mounted in the mounting holes, the wheels being adjustable and being removable only by access from the interior of the enclosures. A handle fastener is accessible only from the interior of the enclosure. A transport handle is adapted to be attached to the handle fastener. A tie-down fastener is adapted to secure the enclosures to a surface on which the enclosures are supported, the tie-down fastener being accessible only from the interior of one of the enclosures. A spring is provided for opening one of the doors.

DESCRIPTION OF THE INVENTION

Figure 1:
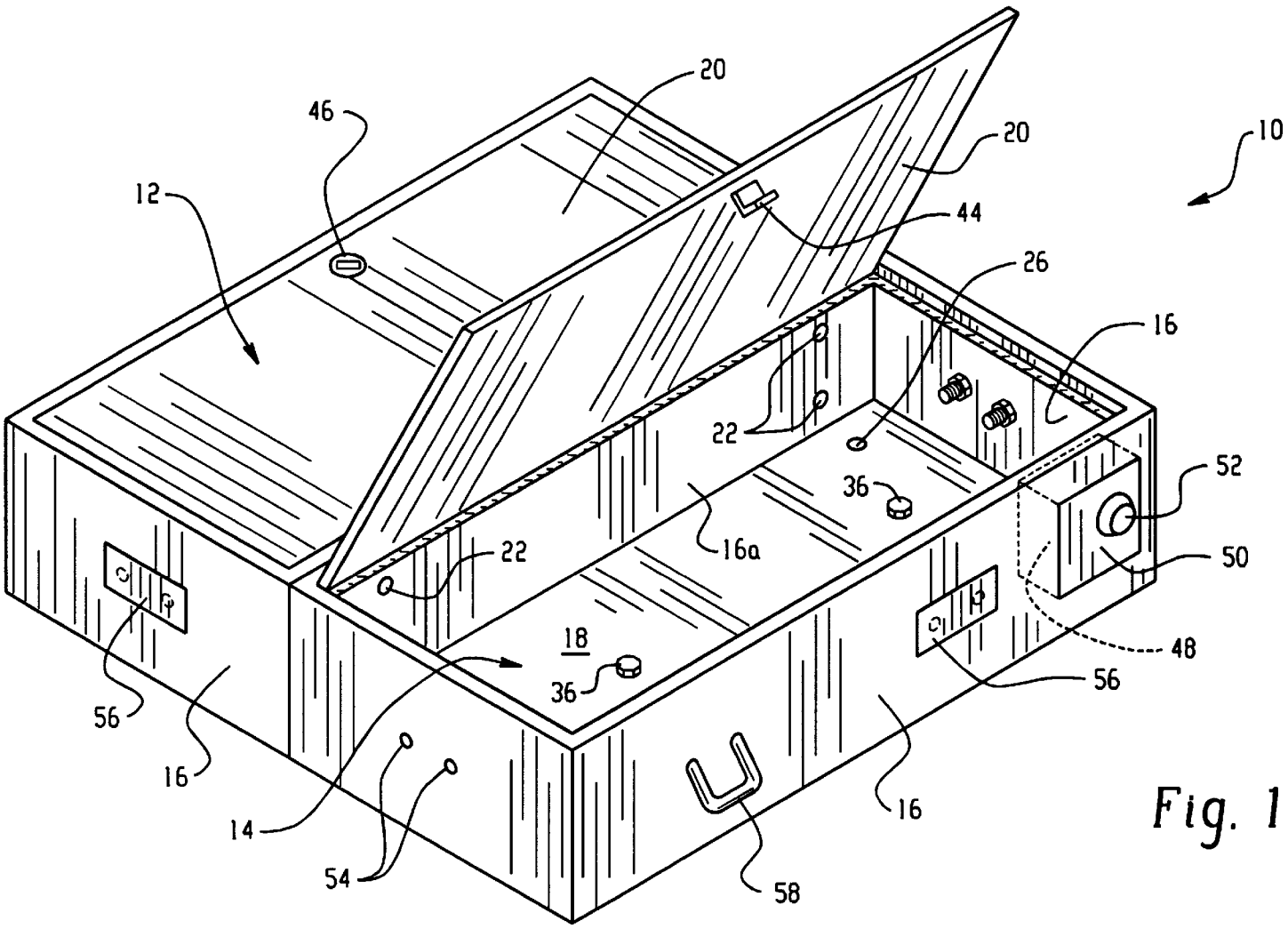
FIG. 1 shows an isometric view of a safe according to the invention.
Figure 2:
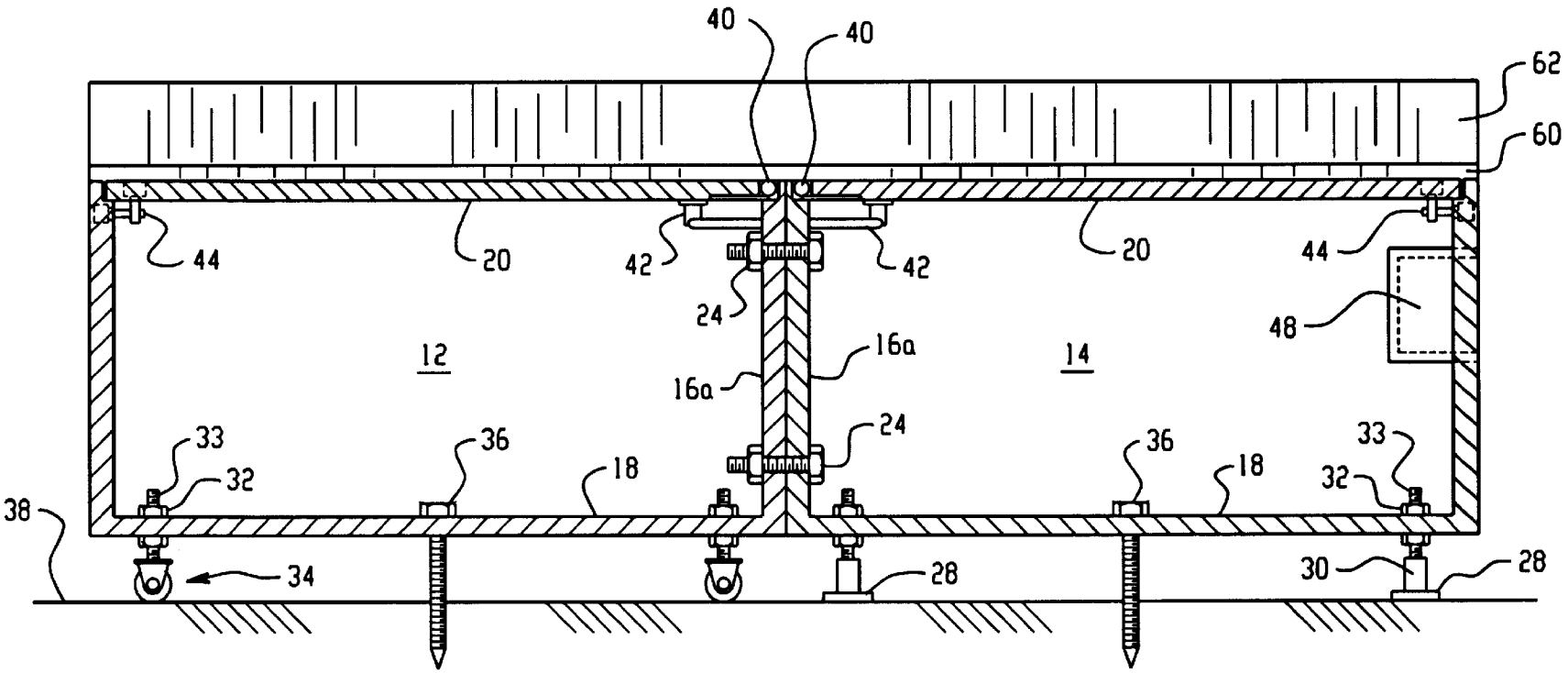
FIG. 2 shows an end view of the safe in section.

Referring to FIGS. 1 and 2, a safe 10 includes a first enclosure 12 and a second enclosure 14. Each enclosure is formed by four side walls 16 and a bottom wall 18. A door 20 closes an upper opening of each enclosure 12, 14. One side wall 16*a* of each enclosure 12, 14 is provided with holes 22 therethrough. The side walls 16*a* with holes 22 are disposed adjacent each other so that tops of the doors 20 define a substantially contiguous flat surface. Attachment fasteners 24, such as nut and bolt assemblies, are installed in the holes 22 to secure the enclosures 12, 14 together such that the adjacent side walls 16*a* are flush.

The bottom walls 18 are provided with mounting holes 26. Feet 28 are mounted in the mounting holes 26. The feet 28 are vertically adjustable, for example, by a threaded sleeve 30. The feet 28 are secured in the mounting holes by fasteners 32, such as nuts threaded on posts 33. Roller assemblies 34, including for example wheels, can be mounted in the mounting holes 26 after removing the feet 28. The roller assemblies 34 preferably have posts 33 secured by the same fasteners 32 as the feet.

The feet 28 and roller assemblies 34 are mounted such that the rollers can only be installed by accessing the interior of the enclosure 12, 14. For example, the mounting holes 26 and posts are asymmetrical, each having one flat side that corresponds to prevent rotation of the post in the hole. Thus, the fastener 32 can only be removed from inside the enclosure. Alternatively, the post and hole have a nonstandard cross section, such as a septagon, or a keyed shape that requires use of corresponding roller assemblies not easily obtained. Floor mounting screws 36 extend through the bottom wall 18 to secure the enclosures 12, 14 to a supporting surface 38.

The doors 20 are provided with hinges 40 along the top edges of the adjacent walls 16*a*. The hinges are recessed to provide a smooth top and are welded or otherwise attached so that they cannot be removed from the exterior of the enclosures. Spring mechanisms 42 retard closing and may assist opening of the doors 20. Locks 44 are provided along edges of the doors 20 and have recessed key holes or combination operators on the tops of the doors. Alternatively, the doors can slide laterally. Alternatively or in addition, locking drawers sliding outwardly can be provided. Preferably, the spring 42 opens the door slightly when unlocked to facilitate access. Alternatively, recessed handles can be provided for opening. A recessed enclosure 48 can be provided at one of the side walls for storing a handgun. The recessed enclosure is closed by a door 50 secured by a combination lock 52 permitting quick, blind operation. Handle mounts 54 are provided in the side walls 16. These are provided with covers 56 or otherwise disabled such that handles 58 can be installed only by accessing the interior of the enclosures 12, 14.

When assembled, the enclosures have the size and shape of any standard size box spring. A pad 60 rests on top of the doors 20 and supports a mattress 62.

The present disclosure describes several embodiments of the invention, however, the invention is not limited to these embodiments. Other variations are contemplated to be within the spirit and scope of the invention and appended claims.

What is claimed is:

1. A safe comprising:

a first enclosure defined by walls and having an opening;

a second enclosures defined by walls and having an opening, the second enclosure being positioned such that one of the walls of the second enclosure is adjacent one of the walls of the first enclosure;

multiple corresponding holes provided through the adjacent walls;

fasteners disposed in the holes for securing the first and second enclosures together, the fasteners being accessible only from the interior of the enclosures;

mounting holes in one wall of each enclosure;

feet adapted for being mounted in the mounting holes, the feet being adjustable and being removable only by access from the interior of the enclosure; and wheels adapted for being mounted in the mounting holes, the wheels being adjustable and being removable only by access from the interior of the enclosure.

2. A safe according to claim 1 further comprising a first door for closing the opening of the first enclosure;

a second door for closing the opening of the second enclosure;

hinges along respective top edges of the adjacent walls for pivotably attaching the doors to the enclosures, the hinges being recessed so as not to protrude above the doors;

3. A safe according to claim 1 further comprising a handle fastener accessible only from the interior of the enclosure;

a transport handle adapted to be attached to the handle fastener.

4. A safe according to claim 1 further comprising a spring for opening one of the doors.

5. A safe comprising:

a first enclosure defined by four side walls and a bottom and having an opening;

a second enclosure defined by four side walls and a bottom and having an opening, the second enclosure being positioned such that one of the walls of the second enclosure is adjacent one of the walls of the first enclosure;

multiple corresponding holes providing through the adjacent walls;

fasteners disposed in the holes for securing the first and second enclosures together, the fasteners being accessible only from the interior of the enclosures;

a first door for closing the opening of the first enclosure;

a second door for closing the opening of the second enclosure;

hinges along respective top edges of the adjacent walls for pivotably attaching the doors to the enclosures, the hinges being recessed so as not to protrude above the doors;

locks for locking the first and second doors;

mounting holes in the bottom walls;

feet adapted for being mounted in the mounting holes, the feet being adjustable and being removable only by access from the interior of the enclosures;

wheels adapted for being mounted in the mounting holes, the wheels being adjustable and being removable only by access from the interior of the enclosures;

a handle fastener accessible only from the interior of the enclosure;

a handle fastener cover adapted to be attached to the handle fastener and removable only by access from the interior of the enclosure, a transport handle adapted to be attached to the handle fastener; and a tie-down fastener adapted to secure the enclosures to a surface on which the enclosures are supported, the tie-down fastener being accessible only from the interior of one of the enclosures.

* * * * *